US005204231A

United States Patent [19]

Stockel et al.

[11] Patent Number: 5,204,231

[45] Date of Patent: Apr. 20, 1993

[54] WHITE SAFELIGHT HANDLEABLE PHOTOGRAPHIC FILM CONTAINING A FILTER DYE LAYER

[75] Inventors: Elfriede Stockel, Queens Village; Thomas R. Smith, Selden, both of N.Y.

[73] Assignee: Konica Imaging, U.S.A., Inc., Glen Cove, N.Y.

[21] Appl. No.: 861,123

[22] Filed: Mar. 31, 1992

[51] Int. Cl.[5] ..... G03C 1/46

[52] U.S. Cl. ..... 430/507; 430/517; 430/520

[58] Field of Search ..... 430/507, 520, 517

[56] References Cited

U.S. PATENT DOCUMENTS

| | | | |
|---|---|---|---|
| 3,672,898 | 6/1972 | Schwan et al. | 430/507 |
| 3,990,898 | 11/1976 | Land | 430/30 |
| 4,220,711 | 9/1980 | Nakamura et al. | 430/507 |
| 4,599,301 | 7/1986 | Ohashi et al. | 430/505 |
| 4,801,525 | 1/1989 | Mihara et al. | 430/518 |
| 4,855,220 | 8/1989 | Szajewski | 430/505 |
| 4,952,485 | 8/1990 | Shibahara et al. | 430/502 |
| 4,988,611 | 1/1991 | Anderson et al. | 430/494 |

FOREIGN PATENT DOCUMENTS

| | | |
|---|---|---|
| 57185038 | 11/1981 | Japan . |
| 61-159637 | 7/1986 | Japan . |
| 3230154 | 2/1990 | Japan . |

*Primary Examiner*—Charles L. Bowers, Jr.
*Assistant Examiner*—Geraldine Letscher
*Attorney, Agent, or Firm*—Morgan & Finnegan

[57] ABSTRACT

A film containing a filter layer comprised of a combination of a green dye and a yellow dye, which prevents the blue wavelength of white safelight from exposing the film. The filter layer permits handling of the film under white safelight for longer periods of time.

28 Claims, 6 Drawing Sheets

WHITE SAFELIGHT HANDLEABLE PHOTOGRAPHIC FILM CONTAINING A FILTER DYE LAYER

FIELD OF THE INVENTION

The present invention relates to a photographic paper or film filter layer which protects black and white photographic film used in the graphic arts from unwanted density generation (fog) due to exposure under white safelight. More particularly, it relates to a layer comprised of a mixture of a green dye and a yellow dye disposed over a silver halide layer to filter out the wavelengths in the blue region of the spectrum of the white safelight, while maintaining the speed of the response of the film to the light from a Quartz lamp.

This filter layer also gives excellent protection against unwanted density generation as a result of exposure to yellow safelights.

BACKGROUND OF THE INVENTION

Photographic film contains silver halide as the light-sensitive material. Silver halide, being light sensitive, must be handled either in complete darkness, or under light of a wavelength and intensity to which the silver halide is not sensitive. The purpose of this is to prevent the grains from being rendered developable in areas other than those of the imagewise exposure. However, working either in complete darkness or under extremely subdued light is, at best, inconvenient and can pose hazards especially when chemicals, such as those needed to process photographic materials, are in use. Additionally, working under dim, often red, light can cause eye strain.

In handling any photographic material, it is, therefore, advantageous to be able to work under a light that is as bright as possible, as long as that light will not generate unwanted density on the film. The brighter light permits the material, as well as any equipment, written directions, or labels, etc., to be seen more easily. Besides brightness, it is also preferable to have the light appear as nearly white as possible, so as to diminish strain on the vision of the user which often results from working under red, yellow, or green safelight conditions.

Lamps emitting a wavelength of light which will not produce a developable image on a particular light-sensitive photographic material are called "safelights." Ordinarily, photographic film can be handled under certain safelight for a specific amount of time before image develops on the photographic material. For example, if blue light is to be used to image the film (intentional image formation), the film is commonly prepared and handled under a yellow safelight. Often, a yellow safelight is used in conjunction with a top coat layer containing a yellow filter dye. This filter dye layer acts to absorb limited amounts of blue light, further preventing the formation of unwanted images on the photographic film.

Photographic Dyes have been used to enable the handling of photographic film under safelight or to improve the sensitivity of the film:

U.S. Pat. No. 4,801,525 of Mihara et al. discloses several dyes, which may be used singly or in combination in a hydrophilic colloidal layer which, when coated over a silver halide light-sensitive material having high sensitivity to infrared light, permits handling of the light-sensitive material under various safelights. There is no disclosure, however, of the use of the green dye of the present invention, nor of the use of this green dye in combination with a yellow dye to form a dye filter layer.

U.S. Pat. Nos. 4,855,220 of Szajewski, 4,599,301 of Osashi et al., 3,990,898 of Land, and 3,672,898 of Schwan et al. disclose the use of dyes or layers of dyes for increasing image sharpness. None of these patents relate to the use of a combination of a green and a yellow dye to decrease the sensitivity of the film under white safelight.

U.S. Pat. No. 4,220,711 of Nakamura et al. discloses the use of at least one hydrophobic UV absorbing compound to prevent color staining of a film when it is exposed to light. U.S. Pat. No. 4,220,711 also discloses that the layer containing the UV absorbing compound may also contain a water soluble dye such as an oxonol dye. This patent does not, however, disclose the green and yellow dye combination of the present invention, or the use of the oxonol dyes to affect the sensitivity of silver halide to safelight.

U.S. Pat. No. 4,952,485 of Shibahara et al. discloses the use of a yellow dye as one element in achieving intensified sharpness and high sensitivity. The patent does not, however, disclose the use of the yellow dye or a combination of a yellow dye with a green dye to decrease the sensitivity of film under white safelight.

The typical films involved in the present invention are black and white sheet films and photosensitive papers used in the graphic arts, namely for making magazine and newspaper layouts. The graphic arts industry, in response to the problems created by handling film in total darkness, or, more typically, subdued red light, began introducing products which could be effectively used under yellow safelight. By using yellow safelight, the film handlers were able to work with the film and reduce any potential hazards in the film handling area. A top coat layer containing a yellow filter dye is commonly applied to the film and, in conjunction with a yellow safelight, unwanted image formation is preventable if the film is handled rapidly.

Yellow safelights, however, did not completely solve the problems confronted in the work area. Eye strain continued to be a problem experienced by those handling the film for hours at a time. Additionally, many other jobs could not be performed in the film handling area due to lack of light, for example, proofreading of layouts or handling of chemicals. This created the need for a "brighter" and more normally lighted working environment.

As the safelight environment gets brighter, greater care must be taken in the design of the film so as to prevent unwanted density formation, or "fogging," as a result of exposure to that safelight. The ideal situation, of course, would be a film which maintains a high sensitivity to the light emitted by the intended exposure source and yet has no sensitivity to the safelight.

Practically, this problem can be addressed by offering photographic materials requiring an imaging light source of significantly higher intensity and different wavelength than the safelight. For example, a metal halide lamp can be used as the imaging light source for low sensitivity films. However, these high energy light sources are costly to buy and operate, and they pose a health risk to the operators because they emit UV radiation.

Therefore, it would be desirable to have photographic materials which are sufficiently sensitive to be imaged with a light source of moderate intensity, such as the quartz lamp, but which could be used under a white safelight, or roomlight.

A detriment of white safelights, however, is that they have an emission spectrum containing a blue component to which silver halide is intrinsically highly sensitive. In order to make these "white" appearing safelights usable, it is necessary to prevent the silver halide grains from being activated by the blue wavelength portion of the safelight's emission spectrum. This then lessens the potential for the formation of unwanted density (i.e., image formation), often referred to as "safelight fog." One way of accomplishing this goal is to coat the light-sensitive silver halide layer with a highly efficient blue absorbing material.

For example, one may add large quantities of yellow filter dye to a coating over the light-sensitive material to protect the material from "white" safelight emission. However, large quantities of yellow filter dyes in the top coat significantly reduce the intensity of blue, intentional image forming light impinging upon the silver halide layer, thereby significantly slowing the photographic speed of the film.

This created a need for a film with a filter layer that would successfully prevent most of the blue light emitted by the "white" safelight from reaching the silver halide, while not slowing the speed of the film in response to image forming quartz light. This would eliminate the choice film handlers must make today between light-sensitive materials which can be handled under bright safelight but require long or high intensity exposure due to low sensitivity, or those which must be handled in subdued red or yellow light.

The preferred situation would be to have a film with a filter layer which would prevent unwanted imaging during handling by filtering the wavelengths of blue light being emitted from the safelight, while not substantially slowing the speed of the film to the intentional image forming source.

Accordingly, an object of this invention is to provide a filter layer which, when coated over a light-sensitive emulsion layer, will reduce the formation of unwanted images when exposed to "white" safelight and thereby permit handling of the photographic film under such "white" safelight.

A further object of the invention is to provide a filter layer which, when coated over a light-sensitive emulsion layer, will permit handling of the film under safelight but will not slow the speed of the film when exposed to an intentional image forming light source.

SUMMARY OF THE INVENTION

In accordance with these and other objects of the present invention, a photographic film is provided with a filter layer deposited over a light-sensitive silver halide layer, wherein said filter layer contains:

a. between about 0.0065 g/m$^2$ and about 0.204 g/m$^2$ of a green dye having absorbance maxima at 628–632 nm and 430 nm, with the following structure

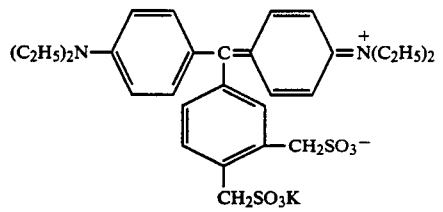

Anhydro-4,4'-bis(diethylamino)triphenylmethanol-3', 4'-disulfomethyl mono potassium salt;

b. between about 0.014 g/m$^2$ and about 0.271 g/m$^2$ of a yellow dye selected from the group consisting of the following:

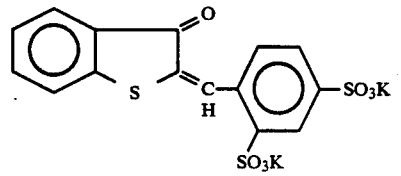

Pan Yellow

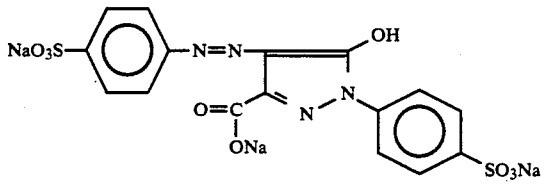

Tartrazine Yellow, and

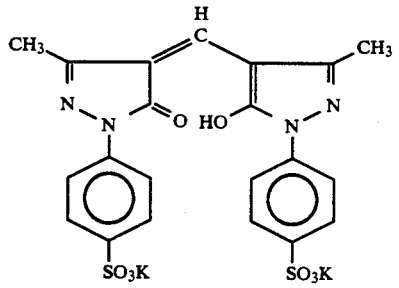

Oxonol Yellow; and c. between about 0.430 g/m$^2$ and about 1.399 g/m$^2$ of a binder.

At any given photographic speed, for emulsions sensitive only to the blue region of the spectrum, this layer containing the green dye in combination with a yellow dye provides significantly improved protection to safelight, and can be handled under white safelights, at an intensity of 800 Lux, for up to 10 minutes without developing unwanted images. Under white safelights of lower intensity, the film can be handled for longer periods (e.g., at 200 Lux the film can be handled for 30 minutes).

DETAILED DESCRIPTION OF THE INVENTION

Figure 1:
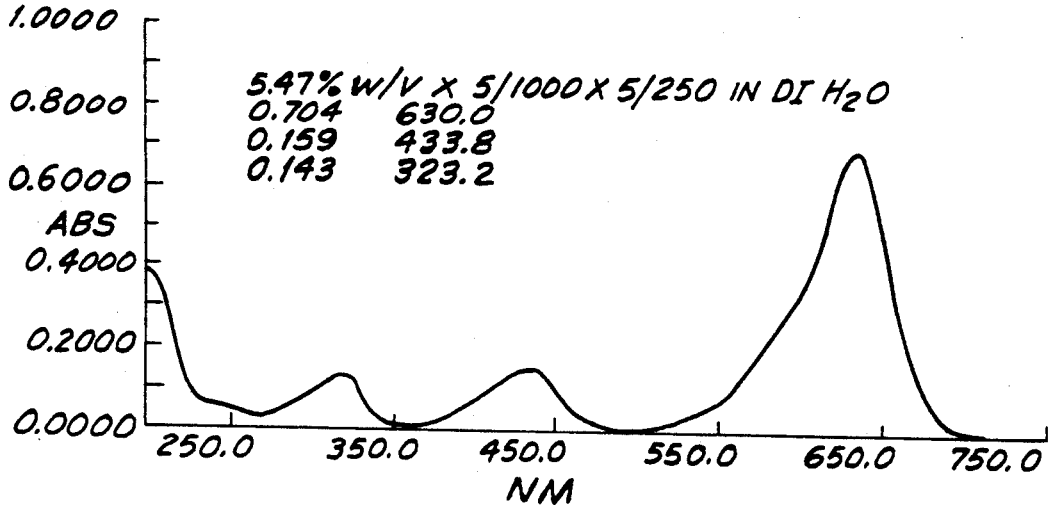
FIG. 1 shows the absorbance spectrum between 200 and 750 nm of the green dye in aqueous solution.

In the practice of one embodiment of this invention, a layer containing a silver halide photographic emulsion is coated on any support suitable for use in photographic elements, for example, but not limited to, paper, polyester, acetate, polymer coated paper, or polymeric film, such as polyethylene terephthalate or cellulose triacetate and diacetate.

The silver halide emulsion layer may be comprised of silver bromide, silver chloride, silver iodide or any combination thereof. Various other additives can be included in this layer as well, for example, antifoggants, surfactants, matting agents, gelatin hardeners, etc., all well-known in the art. Sensitizing dyes may or may not be present in the emulsion. However, spectral sensitivity should not be extended to wavelengths lower in energy than the blue region of the spectrum in order to attain the full benefit of the invention.

The silver halide emulsion mixture is applied to the support in a quantity sufficient to provide a final silver deposition of between 0.5 and 5.0 grams per square meter.

A second layer is then applied on top of the photographic emulsion layer. This second layer may be applied at the same time as the emulsion layer, or after the first photographic emulsion layer has dried. Any coating method capable of providing smooth, uniform layers is appropriate. Examples are: slide, cascade, dip, air-knife, wire-wound (Mayer) rod and draw down coating methods.

Contained in the second layer are the green and yellow dyes in a combination described by this invention. In addition to the dyes, this layer may also include a binder, surfactants or wetting agents, hardeners, and any of the various other additives common to photographic film preparations.

The film forming binder is preferably gelatin, but may be any hydrophilic film forming material, or any combination thereof, either naturally occurring or synthetic polymeric materials. This includes, but is not limited to, cellulose derivatives, protein derivatives, gelatin, derivatized gelatin, polysaccharides, polyvinyl alcohol, acrylic acid polymers, polyvinyl acetates, styrene acrylic acid copolymers, and polyamides. In addition to these hydrophilic colloids and water soluble synthetic polymers, the dye layer may contain polymeric materials which are only slightly water soluble, or are water insoluble, in the form of lattices.

A surfactant or surfactants may be added to wet the surface upon which the filter dye layer is applied, to help in spreading the composition.

The surfactants or wetting agents utilized are preferably anionic fluorinated surfactants, for example, but not limited to, 3M's Fluorad ® FC-129. This may be substituted by any effective anionic wetting agent, such as dioctyl sodium sulfosuccinate, or other fluorinated anionic wetting agents. The anionic wetting agent may be used alone, or in combination with one or more nonionic wetting agents, spreading agents or levelers required to provide effective coatability. Preferably the additional nonionic agent is saponin, a natural glycoside.

Any acceptable hardener may be used which will effectively reduce the solubility of the binder. With the preferred binder being an inert gelatin, a suitable hardener includes, but is not limited to, formaldehyde, glyoxal, glutaraldehyde, and 2,4-dichloro-6-hydroxy triazine. These and other hardeners may be used alone or in combination.

Additionally, an acid is used to adjust the solution to a desired pH. The acid includes, but is not limited to, sulfuric acid, hydrochloric acid, acetic acid, or sulfamic acid. Acid strength should be adjusted to 6 Normal or less before addition to the dye containing mixture.

Finally, any available flatting or matting agent may be used in the dye layer in order to provide the level of gloss desired and to prevent blocking. "Blocking" refers to the sticking together of sheets of film as they are stacked for storage. An example of a useful flatting agent is silica of the type provided by Davison Chemical Co., or U.S. Silica. The particle size is recommended to be between 2 to 15 microns, but is not critical.

In one embodiment of the present invention, the mixture containing the yellow and green dyes, which is coated on top of the silver halide emulsion layer (i.e., on the surface of the emulsion layer opposite to the support), has a total solids content of about 8%. Included in that percentage is about 0.08% to 1.6% of a yellow dye, and about 0.04% to 1.2% of a green dye. Preferably, the filter layer should contain about 0.7% yellow dye and about 0.32% green dye by weight.

The percent of total solids for a given mixture is determined by dividing the weight of a specific volume of the mixture into the weight of the residue of nonvolatiles remaining after evaporation.

This dye layer is applied to the silver halide layer in an amount sufficient to deposit from about 0.014 to about 0.27 grams per square meter for the yellow dye, and about 0.0065 to about 0.204 grams per square meter for the green dye. Additionally, after drying, the filter dye layer contains between about 0.43 and about 1.40 grams per square meter of the binder, and between 0.0 and about 0.54 grams per square meter of the matting agent.

One embodiment of the present invention utilizes a green dye having absorbance maxima at about 628–632 nm and about 430 nm. An example of such a dye which can be used in one embodiment of the present invention is Agfa's PEL-488, represented by the following formula:

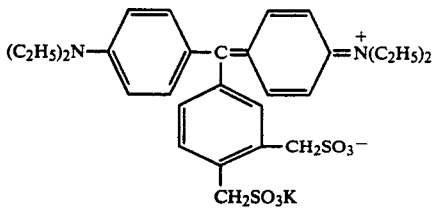

FIG. 1 shows the absorbance spectrum between 200 and 750 nm of this green dye in aqueous solution.

Paired with the green dye is at least one of a conventional yellow dye having an absorbance maximum between 375 and 550 nm. Examples of such dyes are Pan Yellow, represented by the following formula:

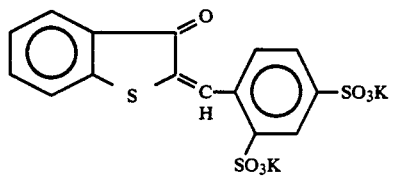

Tartrazine Yellow, represented by the following formula:

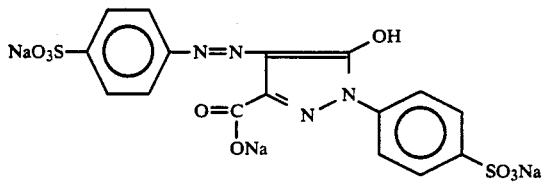

or Oxonol Yellow, represented by the following formula:

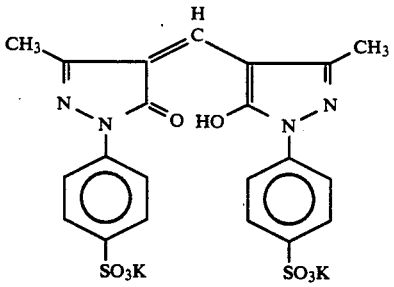

Figure 2:
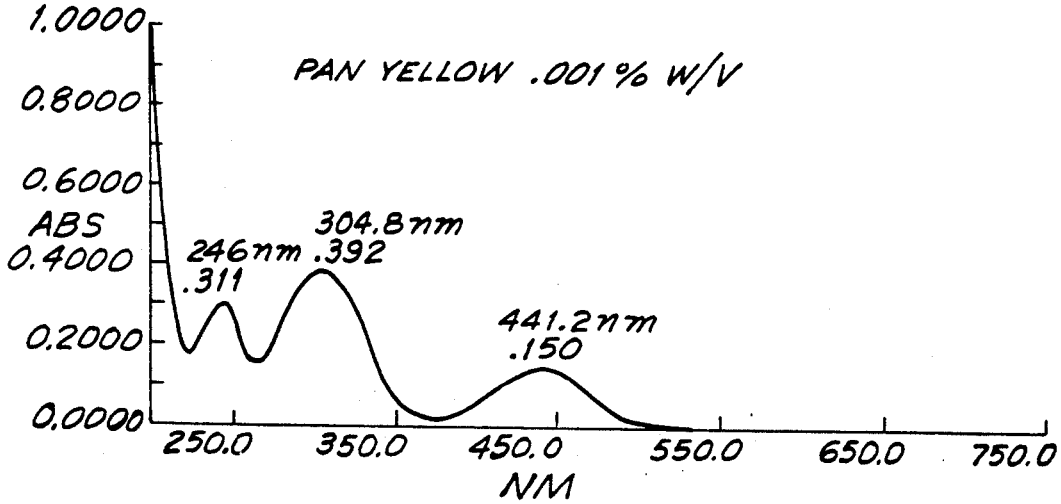
FIG. 2 shows the absorbance spectrum between 200 and 750 nm of Pan Yellow in aqueous solution.
Figure 3:
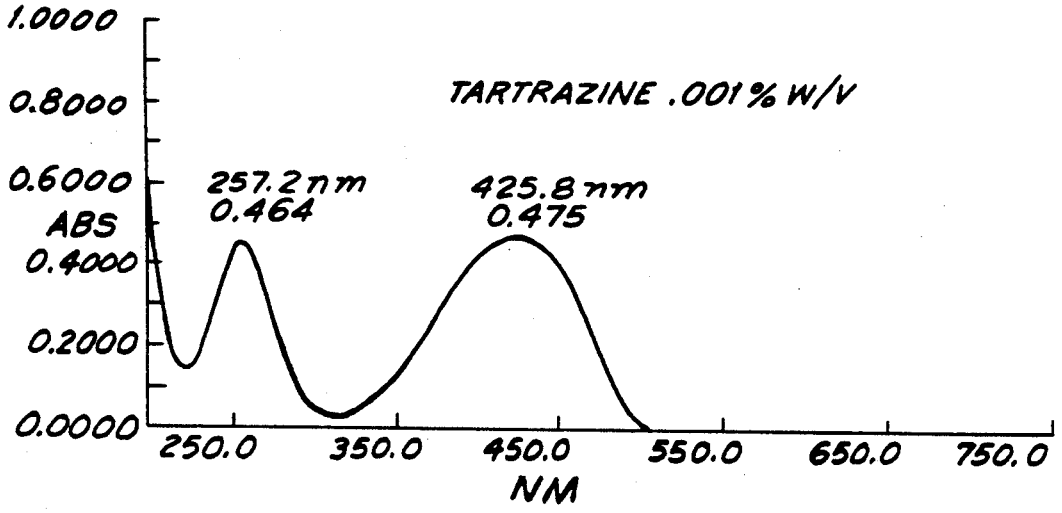
FIG. 3 shows the absorbance spectrum between 200 and 750 nm of Tartrazine Yellow in aqueous solution.
Figure 4:
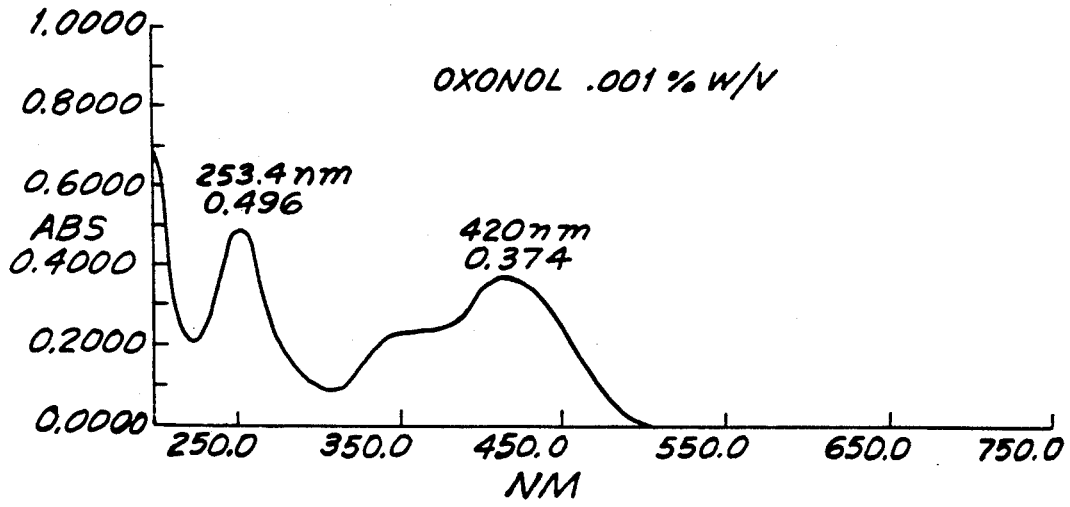
FIG. 4 shows the absorbance spectrum between 200 and 750 nm of Oxonol Yellow in aqueous solution.

FIG. 2 shows the absorbance spectrum between 200 and 750 nm of Pan Yellow in aqueous solution; FIG. 3 shows the absorbance spectrum between 200 and 750 nm of Tartrazine Yellow in aqueous solution; FIG. 4 shows the absorbance spectrum between 200 and 750 nm of Oxonol Yellow in aqueous solution. These dyes are given as examples and are not meant to limit the scope of the present invention. Other dyes or dye combinations absorbing in the range between 375 nm and 550 nm, which will not have adverse sensitometric effects on the photographic emulsion, can also be used.

The top coat filter dye layer may be coated over the silver halide emulsion concurrent with the latter's application to the support, preferably using a "slide coating process" or "cascade coating process". This is commonly referred to as "wet-on-wet" coating. Alternatively, the top coat filter layer may be coated over the silver halide emulsion layer after the latter has dried. This is referred to as "wet-on-dry" coating.

The silver halide emulsion layer is applied to the support at a rate to provide about 43 ml per square meter. The dye combination top coat layer is applied to the surface of the emulsion layer at a rate to provide between about 10.76 ml and about 21.52 ml per square meter. In a preferred embodiment, the dye combination topcoat layer is applied at a rate to provide about 17 ml per square meter.

The finished coating is, therefore, comprised of a radiation sensitive photographic emulsion layer, positioned between the support and a layer containing the filter dye combination layer of the present invention.

The following examples are meant to illustrate the invention and should not be used to limit its scope.

EXAMPLE 1

A gelatin solution was prepared by dissolving 420 gm of an inert, photographic grade gelatin in 4550 ml of DI (deionized) water at a temperature of 110° F. After the gelatin thoroughly dissolved, the temperature was reduced to 100° F.

To the gelatin solution, while being stirred and maintained at 100° F., the following components were added in the order indicated:

450 ml of a 10% weight/volume solution of Oxonol yellow in DI water was added. The solution was prepared by adding 45 gm of the dye into approximately 400 ml of DI water at room temperature. The mixture was stirred until the dye was completely dissolved and then DI water was added to bring the final volume to 450 ml.

400 ml of a 5% weight/volume solution of the green dye in DI water was added. The solution was prepared in an identical manner as described above, where 20 gm. of the dye was dissolved in DI water at room temperature to yield a final volume of 400 ml.

11 ml of 6 Normal sulfuric acid was added. The pH range of the final solution should be between 4.8 and 5.5.

45 ml of a 1% volume/volume solution of an anionic wetting agent FC-129 was added. This solution was prepared by stirring 0.45 ml of the commercially available concentrate, 3M Fluorad ® FC-129, into 44.55 ml of DI water.

200 ml of a 10% weight/volume solution of a nonionic wetting agent, saponin, was added, which was prepared by dissolving 20 gm of saponin powder in approximately 150 ml of DI water at room temperature. When all the powder had dissolved, the volume was then brought to 200 ml with DI water.

154 ml of a water dispersion of silica ($SiO_2$), having an average particle size range of between 2–15 microns, was added. The dispersion was prepared by adding 10 gm of silica to 150 ml DI water at room temperature and mixing with either a high speed mixer or homogenizer.

203 ml of a 20% weight/volume DI water solution of formaldehyde was added.

After all the aforementioned components were added, stirring was continued for 20 minutes at 100° F. in order to insure complete uniformity of the mixture.

The pH range of the final solution can be between 4.0 and 7.0, but preferably it is between 4.8 and 5.5.

The viscosity of the final solution is between 7.5 and 10.5 centipoise at 40° C. Measurements are taken on a standard Brookfield viscometer.

After the mixture containing the dyes was prepared and while it was maintained at 100° F., it was applied over the emulsion layer.

The photographic emulsion, over which the dye solution was applied, was coated on a paper support at about 1 gram of silver per square meter and then dried.

The dye containing solution described above was coated on top of the emulsion layer in sufficient quantity to provide a coverage of 0.122 gm of the oxonol yellow per square meter and 0.054 gm of the green dye per square meter. Dye coverage can also be measured on the basis of optical density using a standard densitometer such as the Macbeth TR927. Density measured through a blue filter (for yellow color) should be between 0.95–1.15; density measured through a red filter (for the green color) should be 1.0–1.4.

A photographic element was prepared containing a dye combination filter layer according to the preferred embodiment of the invention described immediately above, and was subject to a series of "safelight" tests. The dye combination filter layer was compared against a coating made by the same method, but containing only the yellow dye. "White" safelight refers to the use of UV filter sleeves applied over standard fluorescent bulbs. The safelight used in the test comprised Illumination Technology Ultra White Shield sleeves over 40 watt cool white fluorescent tubes. This safelight had an intensity of 800 Lux. The light source was situated four (4) feet from the film.

For each filter layer, the photographic material was exposed to the "safelight" for 0, 5, 10, 20 and 30 minute intervals. Each sample was then developed and examined for relative levels of optical density. The results for both filter layers tested are presented in Table I:

TABLE I

| Time (min.) | Density A | Density B |
|---|---|---|
| 0 | 0.05 | 0.05 |
| 5 | 0.05 | 0.29 |
| 10 | 0.07 | 1.45 |
| 20 | 0.25 | 1.78 |
| 30 | 0.44 | 1.78 |

A: Oxonol Yellow and Green Dye Combination Top
B: Oxonol Yellow Top Coat

Figure 5:
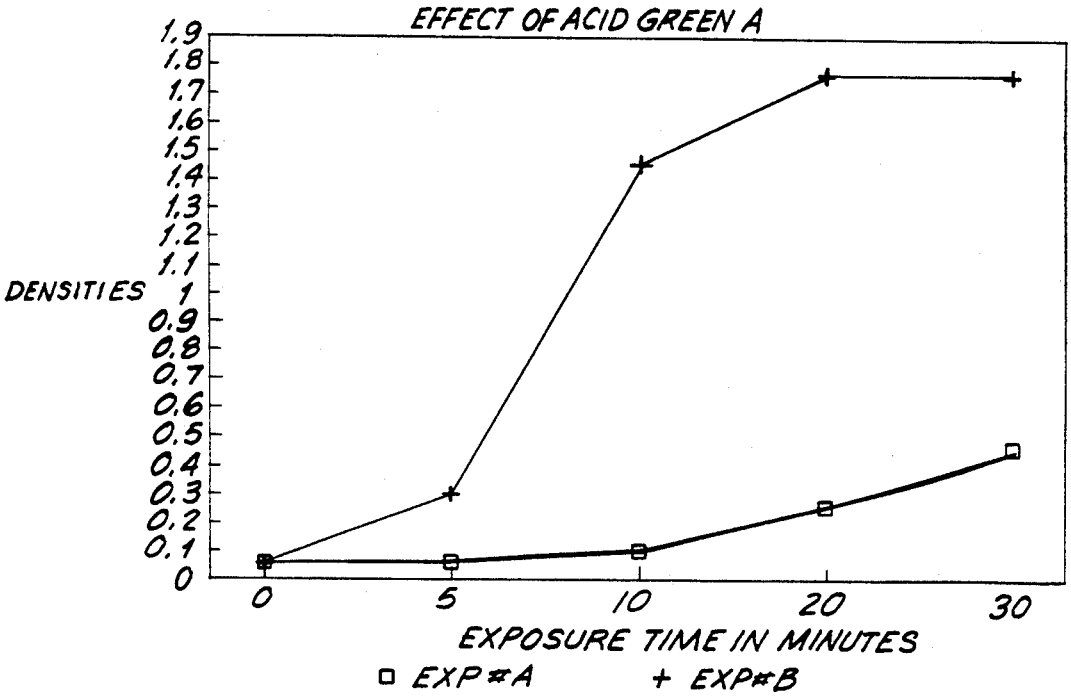
FIG. 5 is a graph comparing the optical density of a film sample containing the green and yellow dye combination compared to a sample coated with a yellow dye alone.

FIG. 5 represents this data in graphical form, distinctly showing that the sample containing the yellow and green dye combination displayed lower optical density, at comparable exposure times, than the samples coated with yellow dye alone.

EXAMPLE 2

A photographic element was prepared in accordance with the method disclosed in the previous example.

Another test was run comparing the dye combination filter layer of the invention to filter layers utilizing only either a yellow dye or only the green dye, called the Stepped Safelight Test. In this test, the samples are exposed to the safelight, at a fixed distance of four feet, for increasing amounts of time. In this case, the interval selected was 5 minutes. The safelight used was the same as that in Example 1, at the same intensity.

Comparison was made between a photographic element containing only the green dye in the topcoat, a photographic element containing only a yellow dye in the topcoat, and a photographic element containing both the green dye and a yellow dye in the topcoat. Included for comparison was a commercially available film product which is advertised and intended for use under "white" safelights.

Figure 6A:
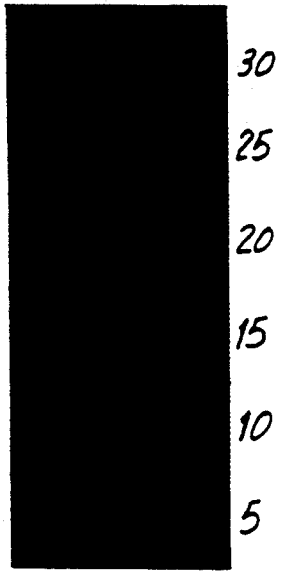
FIGS. 6A, 6B, 6C, 6D, and 6E represent the degrees of sensitivity of photographic film (A) with no dye in the topcoat, (B) with only the green dye in the topcoat, (C) with only Tartrazine Yellow dye in the topcoat, (D) with both the green dye and Oxonol Yellow dye in the topcoat, (E) commercially available product recommended for use under white safelight.

The ideal situation, no safelight sensitivity, would be evidenced by the absence of any density formation at any exposure time. FIGS. 6A through 6E are representative of the degrees of sensitivity of the photographic film containing the filter dye layers. FIG. 6A represents the exposure of film with no dye in the topcoat. The film is completely exposed in less than 5 minutes under the white safelight.

Figure 6B:
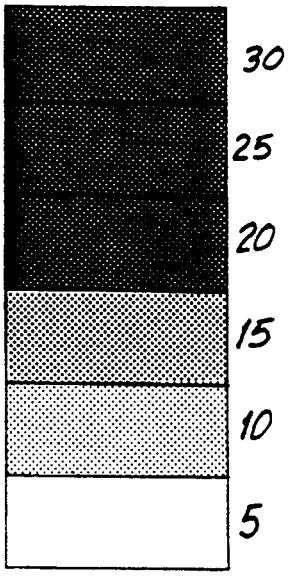

FIG. 6B represents the effect of a filter dye layer containing only the green dye in the topcoat. As shown in the figure, unwanted safelight fog is indicated at the 10 minute interval. "Safelight fog" is defined as unwanted density produced on photographic material as a result of exposure to light emitted from a safelight.

Figure 6C:
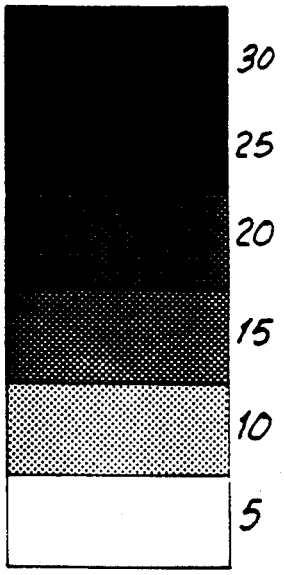

FIG. 6C represents the effect of a filter dye layer containing only a yellow dye in the topcoat, in this case, Tartrazine Yellow. Again, safelight fog appears during the 10 minute exposure time.

Figure 6D:
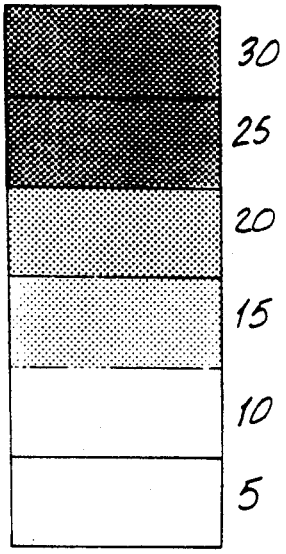

FIG. 6D represents the effect of a filter dye layer containing both the green dye and Oxonol Yellow in the topcoat. Notice that this dye layer displays the least sensitivity, there being no safelight fog in the 10 minute exposure time.

The speed of the film in FIG. 6D on exposure to the Quartz lamp is similar to that of the film having a topcoat with only the yellow dye, and only slightly less than the speed of the film having a topcoat with only the green dye.

Figure 6E:
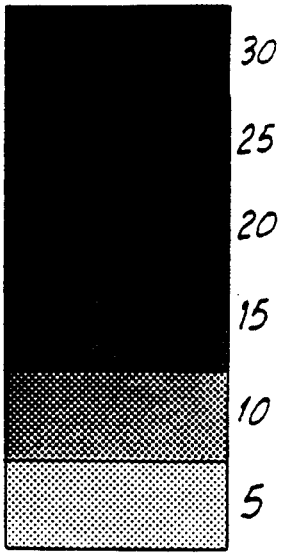

FIG. 6E, a comparable competitive product described as for use under "white" safelight, shows dense fog at the 5 minute interval.

EXAMPLE 3

The same test described in Example 2 was performed under a white safelight with an intensity of 200 Lux. At 200 Lux, the film with the filter layer containing both the green and yellow dyes was handled for 30 minutes without dense fog formation.

This demonstrates the fact that the film of the present invention can be handled for a longer period of time under a white safelight of lower intensity.

EXAMPLE 4

A photographic element was prepared in accordance with the method disclosed in Example 1.

Another experiment was then conducted to compare the photographic speeds of film containing 1) no dye in the topcoat, 2) only the green dye in the topcoat, 3) only a yellow dye in the topcoat, and 4) both the green dye and a yellow dye in the topcoat. In this test, the film samples were exposed for two minutes under a 1000 Watt Quartz lamp through both neutral density gradations (gray scale) and a graded prism which separates the various wavelengths of light.

The gray scale, which appears as a horizontal bar over the numbers 1–20 in FIGS. 7A–7D, indicates direct photographic speed. For example, if the bar on one experiment extends to the number 12, it has, on a comparative basis, greater photographic speed than an experiment for which the bar only extends to the number 4.

The graded prism exposures accompanying each gray scale in FIGS. 7A–7D offer the same information, only they indicate the specific wavelengths at which the sensitivity (speed) occurs. If no image is visible, it means there is insufficient sensitivity to generate one.

Figure 7A:
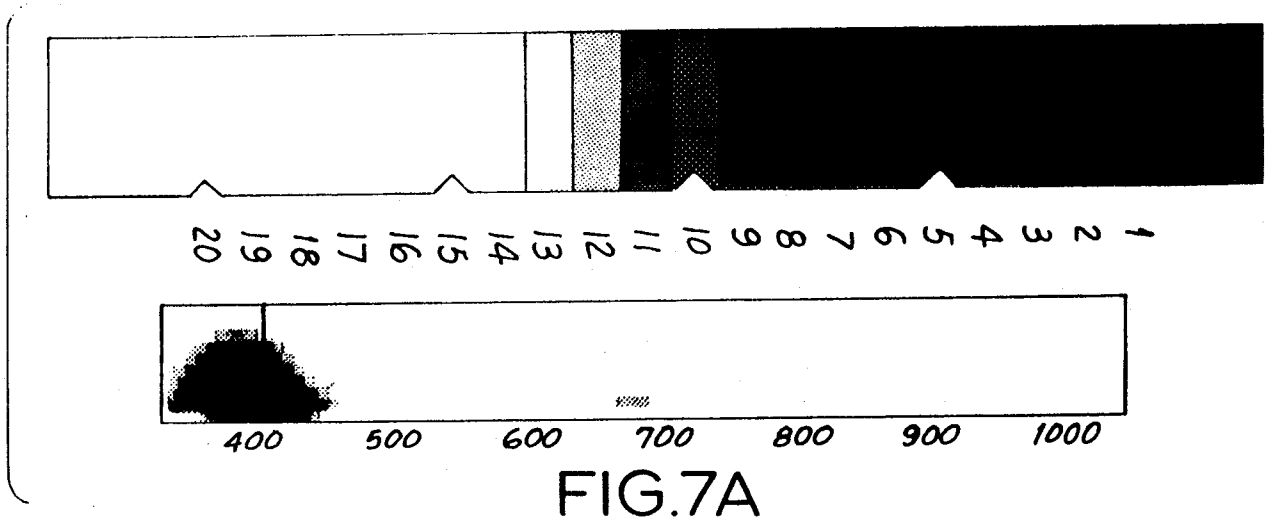
FIGS. 7A, 7B, 7C, and 7D represent the comparative photographic speeds of film (A) with no dye in the topcoat, (B) with only the green dye in the topcoat, (C) with only Tartrazine Yellow dye in the topcoat and (D) with both the green dye and Oxonol Yellow dye in the topcoat.
Figure 7B:
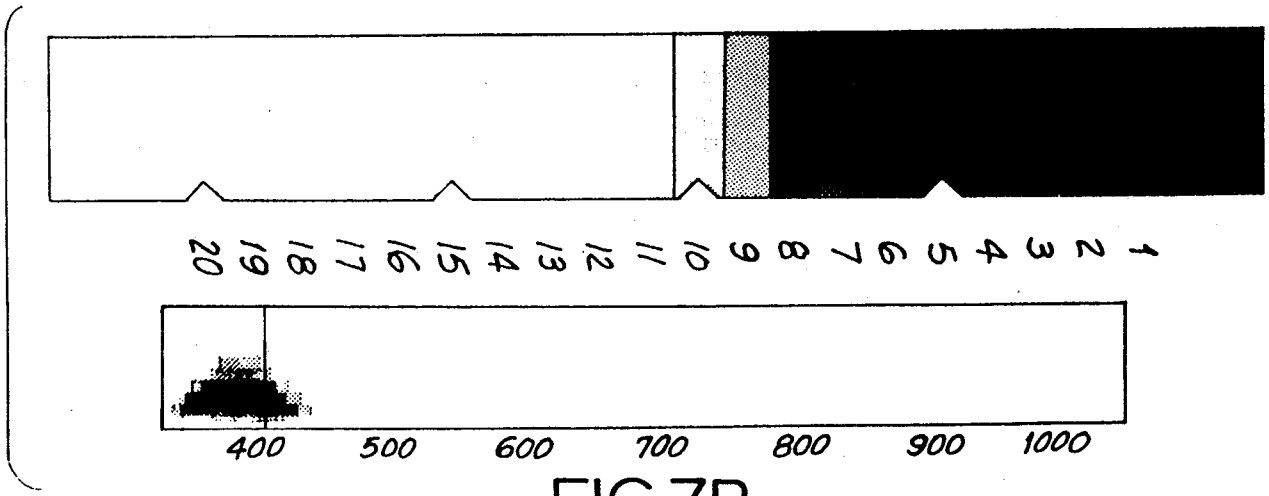
Figure 7C:
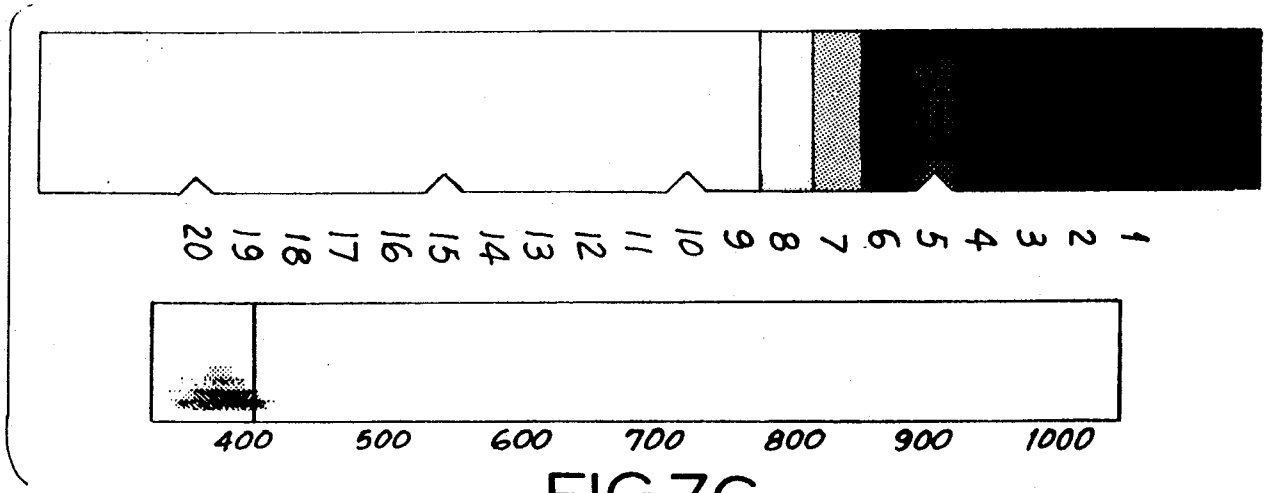
Figure 7D:
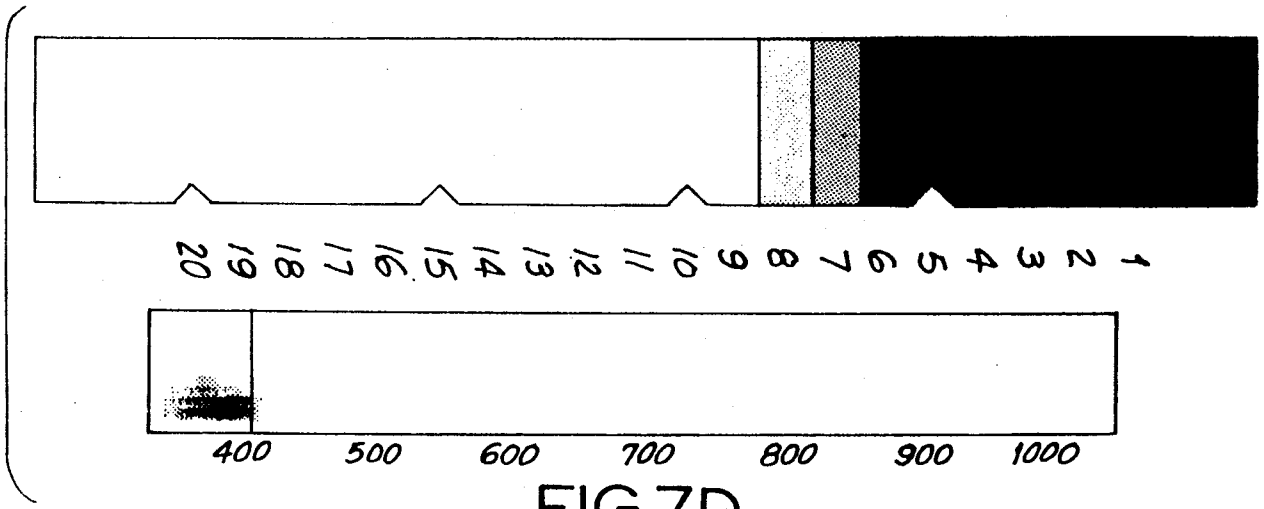

Comparing FIGS. 7B-7D, it is evident that the photographic speed on exposure to the Quartz lamp of the film containing the green dye and Oxonol Yellow in the topcoat is similar to the speed of the film containing only a yellow dye in the topcoat, and only slightly less than the speed of the film containing the green dye in the topcoat.

Taken together with the data from Example 2, this shows that the topcoat containing both the green dye and a yellow dye in the topcoat provides maximal protection of the film under a white safelight, while not compromising the speed of the film under quartz light.

These experiments clearly illustrate the superiority of the green and yellow dye combination of a preferred embodiment of the present invention over filter layers containing only green dye, filter layers containing only yellow dyes, and over the existing films on the market advertised for use under "white" safelight.

All of the basic components included in the invention are well-known and commercially available from many sources. Moreover, the invention has been described in detail with particular reference to a preferred embodiment thereof, but it will be understood that the invention is capable of other and different embodiments. As is readily apparent to those skilled in the art, variations and modifications can be affected within the spirit and scope of the invention. Accordingly, the foregoing disclosure, description, and figures are for illustrative purposes only, and do not in any way limit the invention, which is defined only by the claims.

We claim:

1. A film containing a filter dye layer coated over a light-sensitive silver halide emulsion layer on the side opposite the emulsion support, comprising:

A. a support selected from the group consisting of paper, polymer coated paper, and polymeric film;

B. a silver halide emulsion layer coated on one side of said support in a quantity sufficient to provide a final silver deposition of between 0.5 and 5.0 grams per square meter; and C. a filter dye layer on top of said silver halide emulsion layer on the side opposite said support, said filter dye layer comprising:

a. between about 0.0065 g/m$^2$ and about 0.204 g/m$^2$ of a green dye having absorbance maxima at 628-632 nm and 430 nm, with the following structure

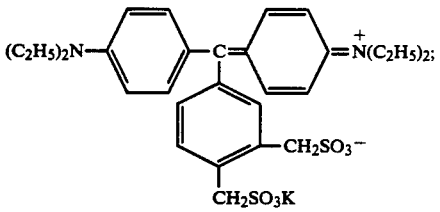

b. between about 0.014 g/m$^2$ and about 0.271 g/m$^2$ of a yellow dye with an absorbance maximum between 375 and 550 nm; and c. between about 0.430 g/m$^2$ and about 1.399 g/m$^2$ of a binder.

2. A film of claim 1 wherein the yellow dye is selected from the group consisting of:

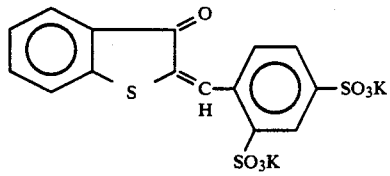

Pan Yellow,

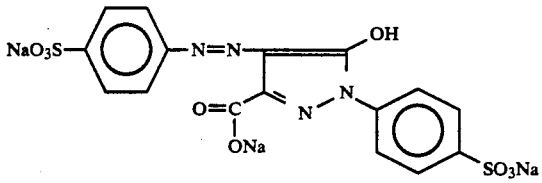

Tartrazine Yellow, and

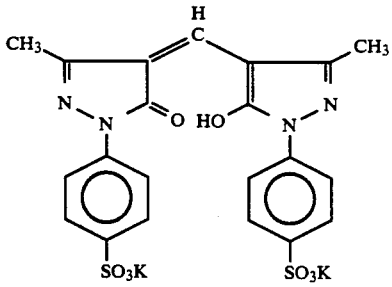

Oxonol Yellow.

3. A film of claim 2 wherein the yellow dye is Oxonol Yellow.

4. A film of claim 1 comprising about 0.054 g/m$^2$ of the green dye.

5. A film of claim 1 comprising about 0.122 g/m$^2$ of the yellow dye.

6. A film of claim 3 comprising about 0.122 g/m$^2$ of Oxonol yellow.

7. A film of claim 1 wherein said filter layer comprising:

a. about 0.054 g/m$^2$ of the green dye;

b. about 0.122 g/m$^2$ of Oxonol yellow; and c. about 1.14 g/m$^2$ of said binder selected from the group consisting of gelatin, gelatin derivative, a synthetic polymer, polyvinyl alcohol, polyacrylamide, and polyacrylate.

8. A film of claim 7 wherein said binder is comprised of gelatin.

9. A film of claim 1, 7, or 8 wherein said filter layer mixture further comprises:

d. between about 0 g/m$^2$ and about 0.54 g/m$^2$ of a silica matting agent with an average particle size between 2 and 15 microns.

10. A film filter dye composition suitable for coating over a light-sensitive silver halide emulsion layer on the side opposite the emulsion support comprising a mixture of:

a. between about 0.04 grams and about 1.2 grams of a green dye having absorbance maxima at 628-632 nm and 430 nm, with the following structure:

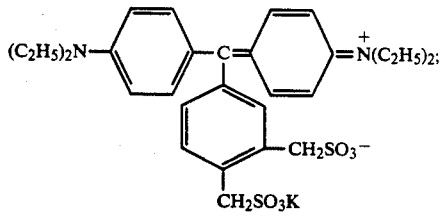

b. between about 0.08 grams and about 1.6 grams of a yellow dye with an absorbance maximum between 375 and 550 nm;

c. between about 2.4 grams and about 7.9 grams of a binder;

d. between about 0.4 grams and about 5.9 grams of a 1% volume/volume solution of an anionic surfactant;

e. between about 1.0 grams and about 7.0 grams of a 20% weight/volume solution of a hardener;

f. water in an amount sufficient to bring the total weight of the final filter dye composition to 100 grams.

11. A filter dye layer composition of claim 10 wherein said yellow dye is selected from the group consisting of:

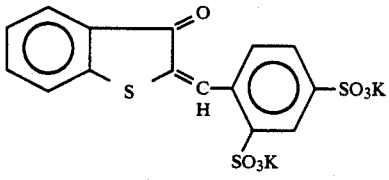

Pan Yellow,

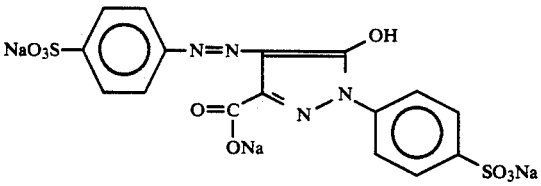

Tartrazine Yellow, and

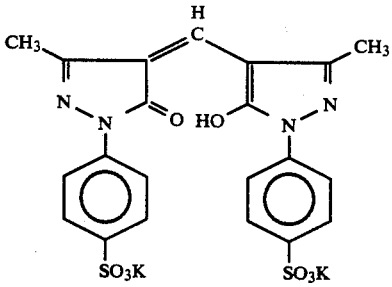

Oxonol Yellow.

12. A filter dye composition of claim 10 containing about 0.32 grams of the green dye.

13. A filter dye composition of claim 10 containing about 0.7 grams of the yellow dye.

14. A filter dye composition of claim 13 containing about 0.32 grams of the green dye.

15. A filter dye composition of claim 11 containing about 0.7 grams of Oxonol yellow.

16. A filter dye composition of claim 10 with an amount of water sufficient to provide, after spreading, a. between 0.006 and 0.204 g/m$^2$ of the green dye;

b. between 0.014 and 0.271 g/m$^2$ of the yellow dye; and c. between 0.430 and 1.399 g/m$^2$ of the binder.

17. A filter dye composition of claim 10 comprising:

a. about 0.32 grams of the green dye;

b. about 0.70 grams of Oxonol yellow;

c. about 6.60 grams of said binder selected from the group consisting of gelatin, gelatin derivative, a synthetic polymer, polyvinyl alcohol, polyacrylamide, and polyacrylate;

d. about 0.007 grams of said anionic surfactant selected from the group consisting of 3M Fluorad ® FC-129, and dioctyl sodium sulfosuccinate;

e. about 0.6 grams of said hardener selected from the group consisting of formaldehyde, glyoxal, glutaraldehyde, and 2,4-dichloro-6-hydroxy triazine; and f. water in an amount sufficient to bring the total weight of the final composition to 100 grams.

18. A filter dye composition of claim 17 wherein:

said binder is gelatin;

said anionic surfactant is 3M Fluorad ® FC-129; and said hardener is formaldehyde.

19. A filter dye composition of claim 18 further comprising:

g. between about 0 grams and about 3.2 grams of a silica matting agent with an average particle size between 2 and 15 microns;

h. an amount of acid, selected from the group consisting of sulfuric acid, hydrochloric acid, acetic acid, and sulfamic acid, to adjust the pH to between 4.0 and 7.0; and i. between about 0.1 grams and about 1.5 grams of a nonionic surfactant saponin.

20. A method of preventing unwanted image formation in a photographic film or paper comprising:

A. selecting a support from the group consisting of paper, polymer coated paper, and polymeric film;

B. coating one side of said support with a silver halide emulsion layer in a quantity sufficient to provide a final silver deposition of between 0.5 and 5.0 grams per square meter; and C. applying a filter dye layer to said silver halide emulsion layer on the side opposite said support, said filter layer, after drying, comprising:

a. between about 0.0065 g/m$^2$ and about 0.204 g/m$^2$ of a green dye having absorbance maxima at 628–632 nm and 430 nm, with the following structure:

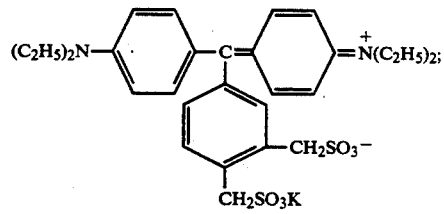

b. between about 0.014 g/m$^2$ and about 0.271 g/m$^2$ of a yellow dye with an absorbance maximum between 375 and 550 nm; and c. between about 0.430 g/m$^2$ and about 1.399 g/m$^2$ of a binder.

21. The method of claim 20 wherein said yellow dye is selected from the group consisting of Pan Yellow, Tartrazine yellow, and Oxonol Yellow.

22. The method of claim 20 wherein said filter layer contains about 0.054 g/m$^2$ of the green dye.

23. The method of claim 21 wherein said filter layer contains Oxonol Yellow.

24. The method of claim 20 wherein said filter layer contains about 0.122 g/m$^2$ of the yellow dye.

25. The method of claim 23 wherein said filter layer contains about 0.122 g/m$^2$ of Oxonol Yellow.

26. The method of claim 20 wherein said filter layer further comprises:

a. about 0.054 g/m$^2$ of the green dye;

b. about 0.122 g/m$^2$ of Oxonol yellow; and c. 1.14 g/m$^2$ of said binder selected from the group consisting of gelatin, gelatin derivative, a synthetic polymer, polyvinyl alcohol, polyacrylamide, and polyacrylate.

27. The method of claim 26 wherein said binder is of gelatin.

28. The method of claim 20, 26, or 27 wherein said filter layer further comprises:

d. between about 0 g/m$^2$ and about 0.54 g/m$^2$ of silica with an average particle size between 2 and 15 microns.

* * * * *